US006771029B2

(12) United States Patent
Ribarich et al.

(10) Patent No.: US 6,771,029 B2
(45) Date of Patent: Aug. 3, 2004

(54) DIGITAL DIMMING FLUORESCENT BALLAST

(75) Inventors: Thomas J. Ribarich, Laguna Beach, CA (US); Cecelia Contenti, Hermosa Beach, CA (US)

(73) Assignee: International Rectifier Corporation, El Segundo, CA (US)

( * ) Notice: Subject to any disclaimer, the term of this patent is extended or adjusted under 35 U.S.C. 154(b) by 0 days.

(21) Appl. No.: 10/108,543

(22) Filed: Mar. 27, 2002

(65) Prior Publication Data

US 2002/0158591 A1 Oct. 31, 2002

Related U.S. Application Data

(60) Provisional application No. 60/279,103, filed on Mar. 28, 2001.

(51) Int. Cl.[7] ..... G05F 1/00

(52) U.S. Cl. ..... 315/292; 315/291; 315/316; 315/DIG. 4

(58) Field of Search ..... 315/292, 316, 315/291, 307, 297, 312, 324, DIG. 4, 293, 224

(56) References Cited

U.S. PATENT DOCUMENTS 4,722,083 A * 1/1988 Tirro et al. ..... 370/323
5,048,033 A * 9/1991 Donahue et al. ..... 372/38.04
5,144,661 A * 9/1992 Shamosh et al. ..... 348/143
5,187,655 A * 2/1993 Post et al. ..... 700/17
5,463,287 A 10/1995 Kurihara et al. ..... 315/308
5,925,990 A 7/1999 Crouse et al. ..... 315/307
6,040,661 A 3/2000 Bogdan ..... 315/224
6,137,240 A 10/2000 Bogdan ..... 315/307
6,181,086 B1 1/2001 Katyl et al. ..... 315/307
6,259,215 B1 7/2001 Roman ..... 315/307
6,271,634 B1 * 8/2001 Saiger ..... 315/241 S
6,337,544 B1 1/2002 Wang et al. ..... 315/291
6,400,103 B1 * 6/2002 Adamson ..... 315/292

* cited by examiner

*Primary Examiner*—Tuyet T. Vo
(74) *Attorney, Agent, or Firm*—Ostrolenk, Faber, Gerb & Soffen, LLP

(57) ABSTRACT

An electronic ballast circuit for powering a gas discharge lamp is networked with other ballast circuits to provide large scale lighting control on a local or remote basis. The ballast has an interface connectable to a standard PC for receiving commands and obtaining query information. The ballasts can be controlled individually or in groups. The ballast control also can download lighting profiles to a microcontroller in the ballast, and can support lighting control protocols including the DALI standard.

16 Claims, 7 Drawing Sheets

DIGITAL DIMMING FLUORESCENT BALLAST

RELATED APPLICATIONS

This application is based on and claims benefit of U.S. Provisional Application Ser. No. 60/279,103, filed Mar. 28, 2001, entitled DIGITAL DIMMING FLUORESCENT BALLAST, to which a claim of priority is hereby made.

BACKGROUND OF THE INVENTION

1. Field of the Invention

The present invention relates to ballast control for gas discharge lamps, and in particular to digitally controlled electronic ballast in a ballast control network.

2. Description of Related Art

Ballasts have been used for many years as part of lighting systems employing gas discharge lamps, and in particular fluorescent lamps. Fluorescent lamps pose a load control problem to the power supply lines that provide lamp power because the lamp load is non-linear. Current through the lamp is zero until an applied voltage reaches a starting value, at which point the lamp begins to conduct. As the lamp begins to conduct, the ballast ensures that the current drawn by the lamp does not increase rapidly, thereby preventing damage and other operational problems.

A type of electronic ballast typically provided includes a rectifier to change the alternating current (AC) supplied by a power line to direct current (DC). The output of the rectifier is typically connected to an inverter to change the direct current into a high frequency AC signal, typically in the range of 25–60 kHz. The high frequency inverter output permits the use of inductors with much smaller ratings than would otherwise be possible, and thereby reduces the size and cost of the electronic ballast.

Often, a power factor correction circuit is inserted between the rectifier and the inverter to adjust the power factor of the lamp circuit. Ideally, the load in an AC circuit should be equivalent to pure resistance to obtain the most efficient power delivery, for the circuit. The power factor correction circuit is typically a switched circuit transfers stored energy between storage capacitors and the load. The typical power inverter circuit also employs switching schemes to produce high frequency AC signal output from the low frequency DC input. Switching within the power factor correction circuit and the rectifier circuit is typically accomplished with a digital controller.

By controlling the switching in the power factor correction circuit and the power inverter circuit, operating parameters of the lamp such as starting, light level regulation and dimming can be reliably controlled. In addition, lamp operating parameters can be observed to provide feedback to the controller for detection of lamp faults and proper operational ranges.

When a number of lighting systems are to be controlled at the same time, it is possible to network a number of electronic lighting ballasts together for individual or group control. For example, a network of electronic lighting ballasts are connected to a building computer control center to control lighting in various building areas and monitor energy use and other parameters related to specific parts of the building. See for example U.S. Pat. No. 6,181,086 to Katyl et al.

It would be desirable to provide an electronic ballast for a lighting control circuit that is connectable to a network and that can store a variety of lighting profiles that can be updated from the network, and provide further dynamic control on a large scale basis.

SUMMARY OF THE INVENTION

The present invention provides a lighting control system using an electronic ballast for controlling a gas discharge lamp. The electronic ballast is connectable to a Personal Computer (PC) and can store various algorithms and lighting profiles that can be updated by the PC. The electronic ballasts can be connected in a network to the PC to define groups of ballasts and lighting circuits for various tasks. Different ballasts can each have specialized lighting profiles loaded into memory for starting, dimming, power control and fault detection.

This software interface is provided to the PC for programming the ballasts and downloading lighting profiles for individual ballasts or define groups of ballasts. Accordingly, the ballasts can be sensed and controlled remotely by the PC. In addition, the PC can be made part of a larger network such as the Internet, to permit observation and control of lighting systems over a wide area in a variety of applications on a remote basis.

BRIEF DESCRIPTION OF THE DRAWINGS

The invention is described in detail with reference to the accompanying drawings, in which.

DETAILED DESCRIPTION OF THE PREFERRED EMBODIMENTS

Figure 1:
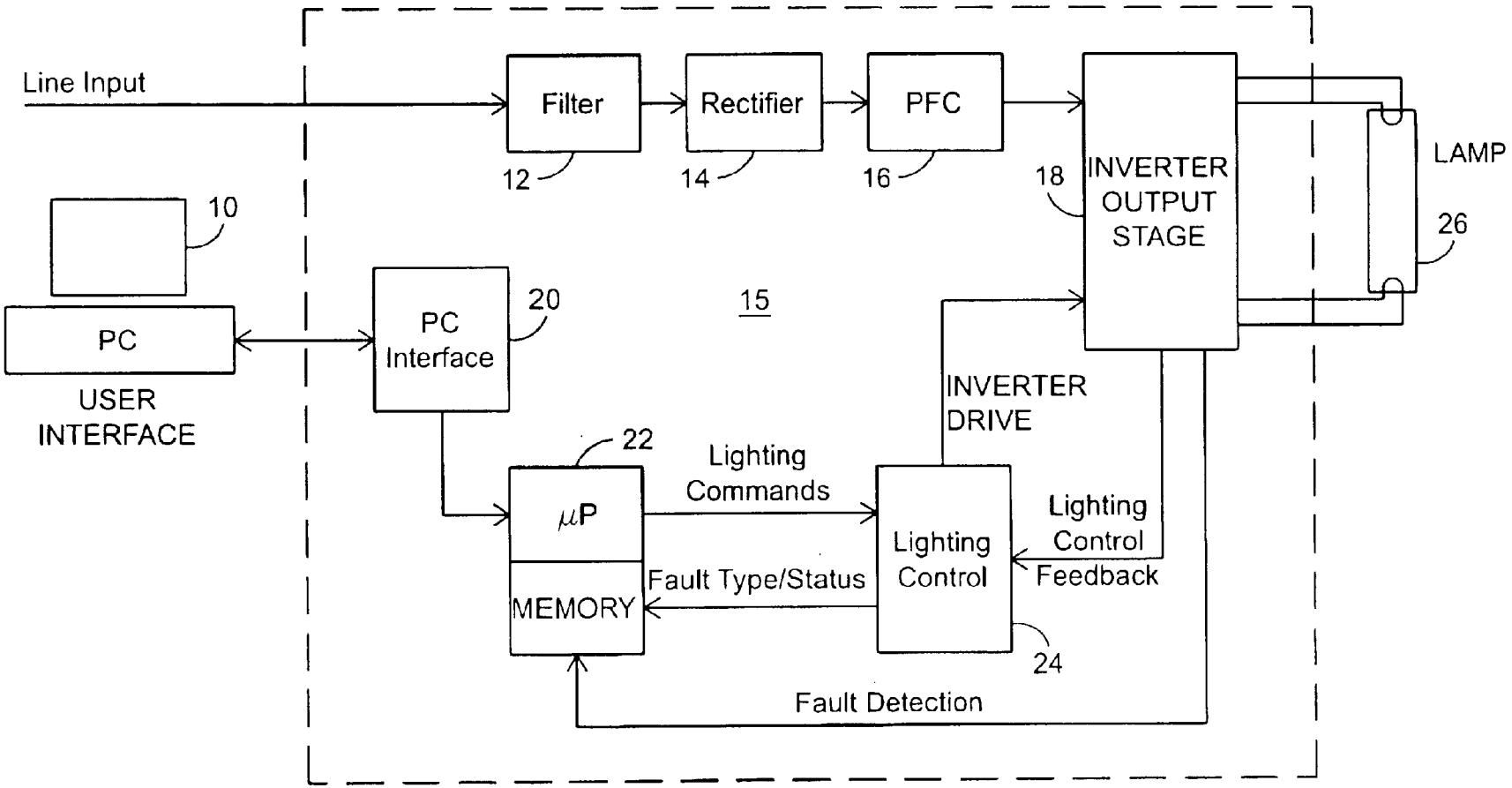
FIG. 1 shows a block diagram of the electronic ballast according to the present invention.

Referring now to FIG. 1, a block diagram of the system of the invention is shown. Gas discharge lamp 26 is powered and controlled by an electronic ballast circuit shown generally as a circuit 15. Circuit 15 receives a power line input for powering the lamp and the various components of circuit 15. The power line input is typically a low frequency AC signal with a frequency ranging from about 50–60 Hz, and a voltage level ranging from about 100–300 V. Accordingly, circuit 15 can be used with virtually any public electric supply available throughout the world.

A filter 12 receives the power line input and removes extraneous high frequency transients to provide a cleaner power signal. Filter 12 is constructed of conventional linear components, such as inductors and capacitors, but can also be an active filter constructed with suitable non-linear components. The cleaner line power signal output from filter 12 is received by a rectifier 14 to provide a DC output. Rectifier 14 is typically a full wave rectifier to provide high power efficiency. The DC output of rectifier 14 is provided to a power factor correction (PFC) circuit 16, which functions to adjust the power factor of the circuit for more efficient operation. In a typical electronic ballast with no PFC circuit, the phase angle of the voltage and current across lamp 26 are out of phase so that the maximum available power is not delivered to the lamp. It is preferable that the input power supply line sees circuit 15 as a purely resistive load in which the voltage and current are in phase with each other. Accordingly, PFC circuit 16 acts to adjust the power factor of the drive signal to lamp 26 to make lamp 26 appear as a purely resistive load to achieve optimal efficiency.

PFC circuit 16 provides a power signal to a power inverter 18 that produces a high frequency drive signal for powering lamp 26. Inverter 18 includes a number of high power, high speed switches used to regulate power flow to lamp 26. Because the switches in inverter 18 are switched at a high frequency, power is delivered to lamp 26 more efficiently and with lower cost components.

Inverter 18 is controlled by a lighting control circuit 24, which provides drive signals for switch operation in inverter 18. Inverter 18 also provides lighting control feedback signals to lighting control circuit 24. The lighting control feedback signals are used to determine the status of the various parameters for operation of lamp 26. Inverter 18 also has fault detection capability for detecting operational faults of inverter 18 and lamp 26.

Operation of lighting control circuit 24 is controlled by a microprocessor 22 that provides lighting control circuit 24 with commands for operation of inverter 18. Microprocessor 22 provides commands for controlling an operation of lamp 26, including starting, dimming, power consumption and extinguishing lamp 26. Microprocessor 22 receives fault detection signals from inverter 18 that are provided as a result of the control profile asserted by lighting control circuit 24. For example, if inverter 18 or lamp 26 experiences a fault, such as a broken component or operation outside of predetermined ranges, inverter 18 notifies microprocessor 22 that a fault has been detected. Microprocessor 22 also receives feedback signals from lighting control circuit 24 that indicates a status of inverter 18 and lamp 26. The status provided by lighting control circuit 24 can include specifics about detected faults and other indicia of inverter 18 and lamp 26 operation. Microprocessor 22 also includes a memory storage for storing information such as lighting control profiles and statuses of inverter 18 and lamp 26. Accordingly, the operation of lamp 26 can be programmed for preheating, ignition, dimming and light level, for example. Faults or statuses of lamp 26 can be stored and recorded in microprocessor 22 for later retrieval or modification.

For example, microprocessor 22 can store an algorithm to put circuit 15 into a safe mode in the case of a detected fault. If lamp 26 malfunctions, for example, power to the lamp can be shut off and circuit 15 can be placed in a standby status. If lamp 26 is replaced, the algorithm stored in microprocessor 22 can detect the replacement, and that the malfunction has been cleared, and can automatically restart replacement lamp 26.

Other features can be realized through microprocessor 22, such as regulation of light level change and rate of light level change. For example, an algorithm can be provided with variable parameters for fading times and fading rates for changes in light level.

Microprocessor 22 is also connectable to external systems to receive control and status information on a remote basis. In the diagram shown in FIG. 1, microprocessor 22 is connected through a PC interface 20 to a user interface 10. The connection between PC interface 20 and user interface 10 is a standard serial connection with DB9 connectors. PC interface 20 provides electrical isolation between circuit 15 and user interface 10 to prevent damage to user interface 10 in the event of a malfunction of circuit 15. The electrical isolation provided by PC interface 20 can be provided through a number of techniques, including optical isolation and high voltage protection. PC interface 20 also permits microprocessor 22 and user interface 10 to communicate statuses, faults and commands bidirectionally.

Figure 6:
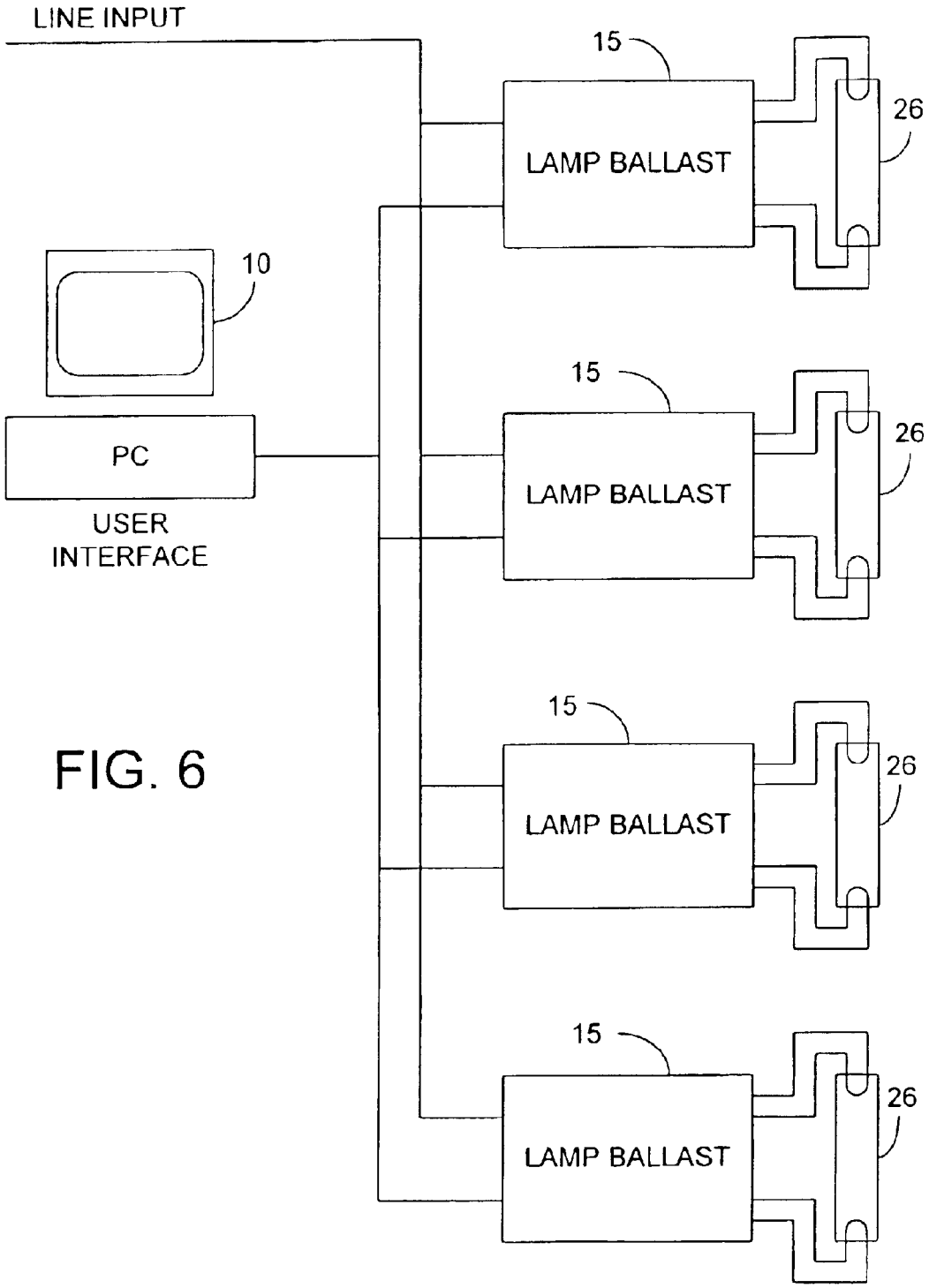
FIG. 6 is a block diagram of a network of lamp ballasts.

Referring also to FIG. 6, microprocessor 22 is also addressable by user interface 10 for bidirectional communication of status, commands, and so forth in a ballast network. For example, microprocessor 22 can receive address information from user interface 10 and determine whether the address information refers to an address of microprocessor 22 or another device in the ballast network connected to user interface 10. Accordingly, the bidirectional communication between user interface 10 and microprocessor 22 can take advantage of a variety of protocols for data communication. For example, Digital Addressable Lighting Interface international standard prlEC929 (DALI) can be used to communicate between user interface 10 and microprocessor 22. The DALI protocol permits 64 addressable devices, arranged in 16 groups and provides 16 different lighting profiles including fade time, fade rate, dimming according to an algorithmic curve and error feedback. Use of a protocol such as DALI permits user interface 10 to communicate with a number of circuits 15 over an entire lighting network. User interface 10 is also independent of circuit 15, and can perform a variety of user functions typically associated with a personal computer. For example, user interface 10 can maintain a history of lighting profiles and statuses on mass storage media. User interface 10 can also record and manipulate statistical data based on operation of an entire lighting network to permit operational reporting and correction for optimal performance. Through recordation and statistical techniques that are available through user interface 10, overall system reliability can be improved while maintaining efficient power usage. In addition, maintenance programs can be designed based on collected data to timely prevent component failure and minimize down time.

User interface 10 also provides simple display screens so that the user can easily change a variety of parameters on a number of addressable circuits 15 at the same time. The display on user interface 10 can also provide a user with feedback showing conditions of various lamps 26 and ballast circuits 15.

Figure 5A:
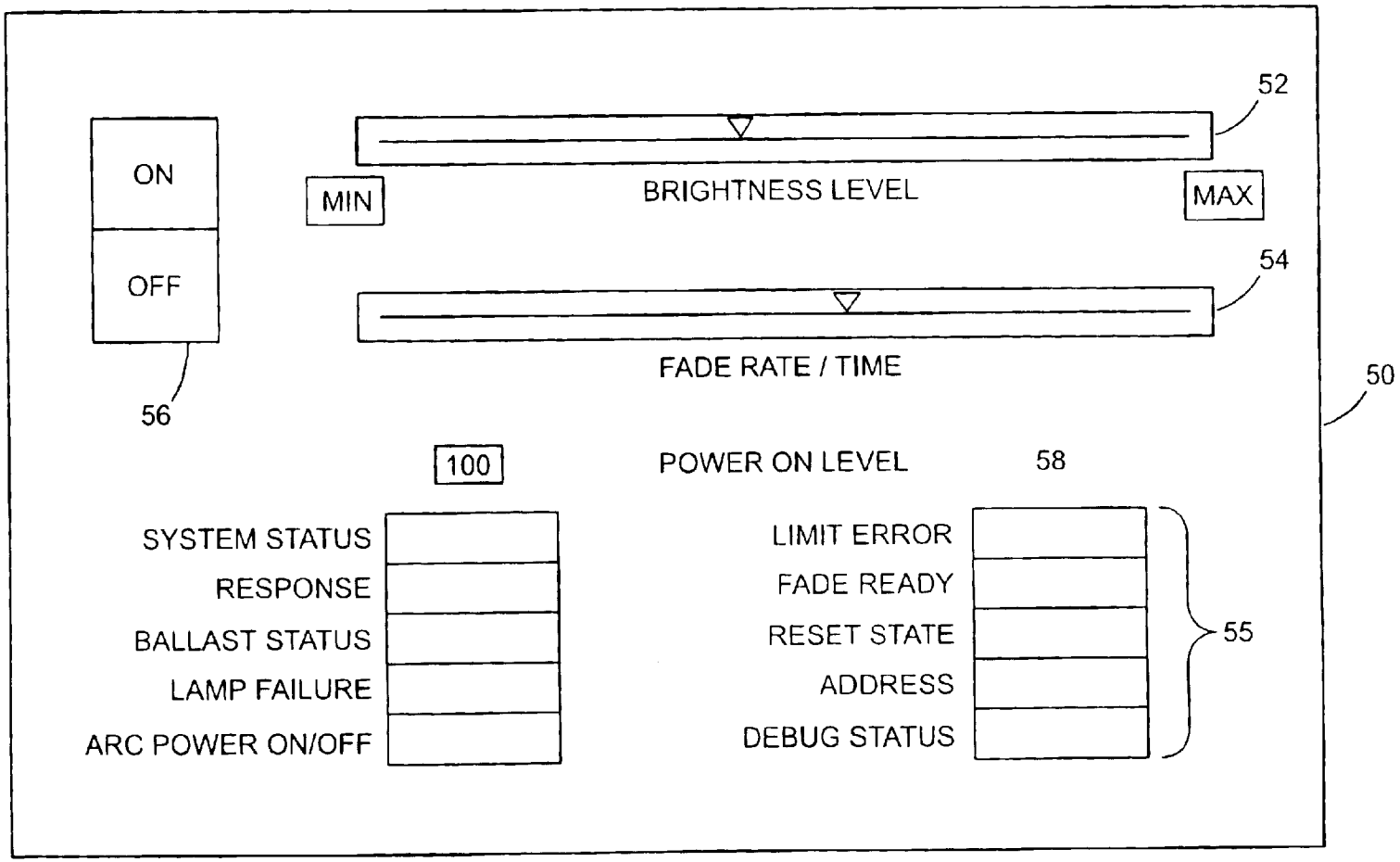
FIG. 5 shows user interface screens displayed on a PC for adjusting light control parameters.
Figure 5B:
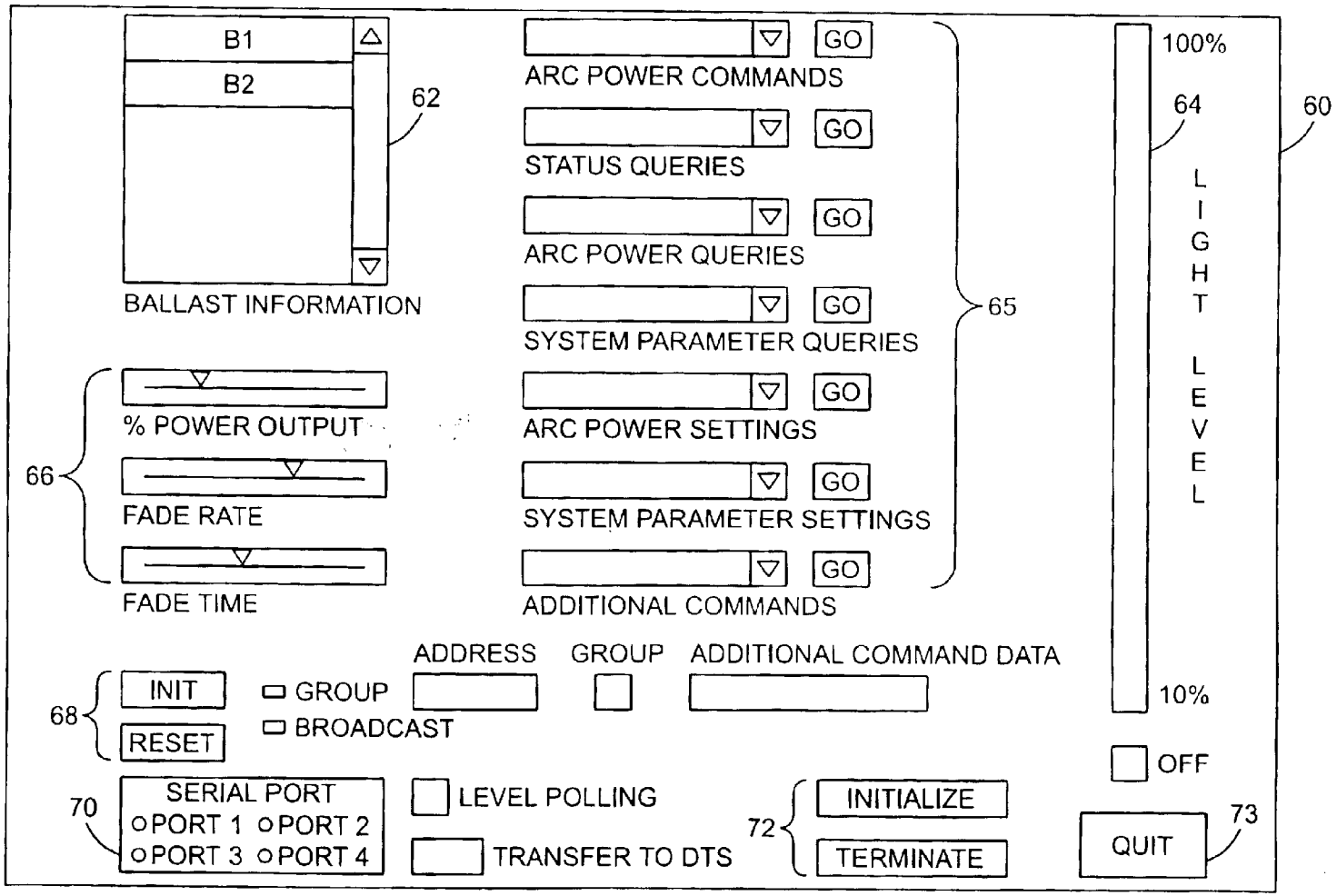

Referring now to FIGS. 5*a* and 5*b*, examples of user displays are provided for operating and observing circuit 15 and lamp 26. Display 50 shows a simple status/control screen for a given ballast. A lamp brightness level can be adjusted using a slide bar 52 to change the light level of the addressed lamp 26. Minimum and maximum buttons are provided with slide bar 52 to immediately set the minimum or maximum value for the brightness level. A slide bar 54 is also provided to adjust the fade rate/time for dimming lamp 26. The simple operations of turning lamp 26 on or off are provided with buttons 56. A power on level as a percent of total power is provided with indicator 58, and is settable by the user. A number of statuses 55 show the condition of various parameters related to operation of the ballast circuit 15 and lamp 26. For example, statuses 55 are available for enunciating the overall system status of circuit 15, i.e., whether the system is in use, in addition to specific statuses for various components of ballast circuit 15 and lamp 26. For instance, the user can immediately observe the address associated with microprocessor 22 of circuit 15.

Referring now to FIG. 5*b*, a display 60 is provided for a user to control and observe lighting statuses from a management perspective. Display 60 includes ballast information in a scrollable screen 62, that is populated with identifiers for a number of ballasts connected to the PC network. In display 60, scroll screen 62 shows entries for ballasts B1 and B2. The user can select any of the ballasts listed to provide command information to the ballast or to obtain ballast status information. For example, light level display 64 provides an indication of the light level for lamp 26 associated with a selected ballast in scroll screen 62. Light level 64 can be used to indicate a light level for a single ballast, or a group of ballasts that are controlled together. Drop down selection bars 65 provide user access to a variety of commands, settings and queries related to operation of a single ballast or groups of ballasts. Each drop down box is associated with an execution button for executing the command displayed in the associated drop down box. For example, the user can select a particular system parameter to query in the drop down box labeled "SYSTEM PARAMETER QUERIES", and then select the execution button next to the drop down box to obtain the particular query information.

Slide bars 66 are also provided for individual ballasts or ballasts operated as a group. Slide bars 66 provide a simple control mechanism for adjusting parameters such as percent power output, fade rate and fade time, for example. Group settings for ballasts can be set up using controls 68 that also provides settings for addressing specific ballasts or groups of ballasts. A serial port in user interface 10 can be selected in a port selection section 70, which also includes options for level polling and DTS settings. Buttons 72 are provided to initialize or terminate communications between user interface 10 and PC interface 20. A QUIT button 73 is provided for simple use by the user to exit the application.

Figure 2:
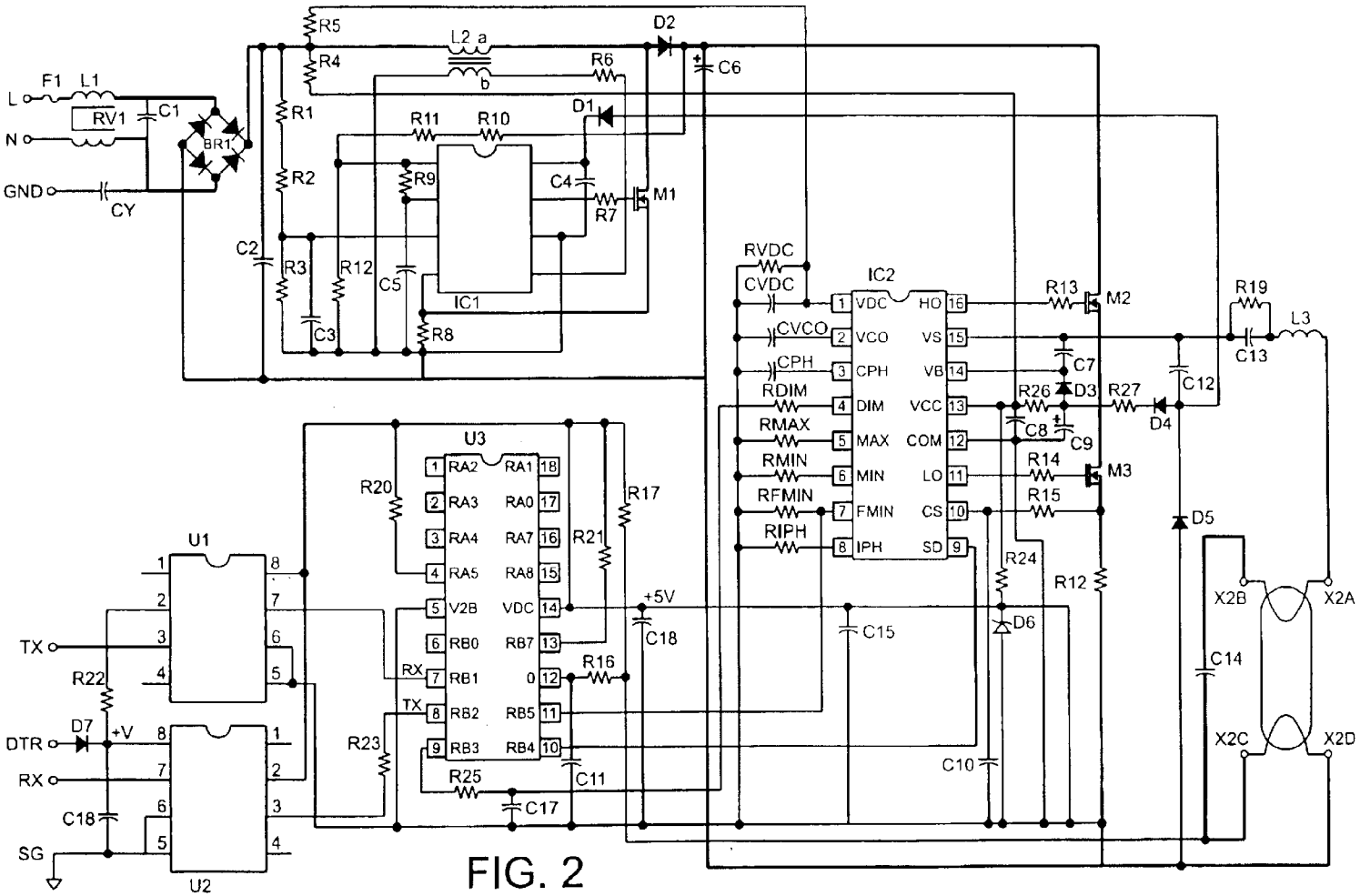
FIG. 2 shows a wiring diagram of the electronic ballast according to the present invention.

Referring now to FIG. 2, a hardware diagram according to the present invention is provided. Filter 12 shown in FIG. 1 is composed of L1, RV1, C1 and CY. This inductor-capacitor combination removes high frequency transients from power supplied through lines L and N. Rectifier 14 is composed of bridge rectifier BR1, which is a full wave rectifier. PFC circuit 16 includes a power factor controller IC1, MOSFET M1, inductor L2, diode D2, capacitor C6, in addition to further biasing, sensing and compensation components. PFC IC1 provides switching control signals from MOSFET M1, which switches to adjust a phase angle between the voltage and current for optimal power efficiency. PFC 16 regulates the output DC bus voltage while providing a sinusoidal signal in phase with the AC input line voltage. Accordingly, PFC 16 boosts and regulates the output DC bus voltage.

Ballast control IC2 includes an oscillator, a high voltage half-bridge gate driver, an analog dimming interface and lamp protection circuit. Ballast control IC2 controls the phase of the half-bridge current to control power delivered to lamp power for lamp 26. Various components connected to IC2 are selected to set parameters such as preheat frequency, current and voltage, preheat time, minimum frequency, ignition voltage and current and running frequency. For example, increasing RIPH increases preheat current, while decreasing CPH decreases preheat time.

Microprocessor 22 shown in FIG. 1 is composed of microcontroller U3, together with variously connected components. Microcontroller U3 can switch ballast controller IC2 on and off by a transition on pin 10 of microcontroller U3. When ballast controller IC2 receives a low to high transition on pin 9, ballast controller IC2 turns on. Similarly, when ballast controller IC2 receives a high to low transition on pin 9, ballast controller IC2 turns off. This function is useful for situations in which a lamp fault is detected and the system is to be placed in a low level operational state to protect the various components.

For example, microcontroller U3 receives lamp fault information on pin 12. If lamp 26 is working correctly, this pin is at a low level, as it is connected to the low potential side of lamp 26. If lamp 26 malfunctions, pin 12 is pulled up to a high level through resistor R17, which prompts microcontroller U3 to transition pin 10 from high to low. The high to low transition on pin 10, connected to pin 9 of ballast controller IC2, causes ballast controller IC2 to turn off. When ballast controller IC2 is turned off, MOSFETs M2 and M3 are not switched, and a low power, safe operation mode results.

When malfunctioning lamp 26 is replaced with properly functioning lamp 26, pin 12 of microcontroller U3 goes to a low level, prompting microcontroller U3 to provide a low to high transition on pin 10. The low to high transition on pin 10 is received on pin 9 of ballast controller IC2, and acts to turn on ballast controller IC2. When ballast controller IC2 is turned on, a lamp restart sequence begins automatically, and lamp 26 is turned on and operated as normal.

Ballast controller IC2 also provides fault status information to microcontroller U3 by placing fault/status signals on pin 7 of ballast controller IC2. Pin 7 of ballast controller IC2 is connected to pin 11 of microcontroller U3, and microcontroller U3 can detect fault information such as stuck logic levels on ballast controller IC2, overcurrent conditions, failure to strike and bus problems, for example. When ballast controller IC2 is off, pin 7 is in a low state, and when ballast controller IC2 is on, pin 7 is raised to a high state.

Ballast controller IC2 can also provide microcontroller U3 with fault signals that are determined when ballast controller IC2 is turned on. Accordingly, microcontroller U3 can detect that ballast controller IC2 is off by examining the condition of pin 11 of microcontroller U3. Microcontroller U3 can then attempt to turn on ballast controller IC2 by transitioning pin 10 of microcontroller U3 from a low to high level. Ballast controller IC2 then turns on, and if a fault is detected, ballast controller IC2 can set pin 7 to a low level. Pin 11 of microcontroller U3 receives the fault signal from ballast controller IC2 and thereby determines that a fault has occurred. Microcontroller U3 can then respond to this fault detection in a number of ways, according to its programming for reacting to a detected fault. For example, microcontroller U3 can issue a command to turn off lamp 26, or to turn off ballast controller IC2.

Microcontroller U3 also controls lighting level by sending on pin 9 a pulse width modulated (PWM) signal, which is converted to a DC voltage through an RC filter composed of R25 and C17. Ballast controller IC2 receives the voltage signal on pin 4 and adjusts the phase of the half-bridge current adjust power delivered to lamp 26 to change the light level accordingly. Precise control of lighting level is obtained by adjusting the duty cycle of the PWM signal supplied on pin 9 of microcontroller U3. In addition, microcontroller U3 can operate under the control of an algorithm that permits the rate of light level change to be controlled. For example, changes in the duty cycle of the PWM signal provided on pin 9 of microcontroller U3 can be made at intervals according to the programming of microcontroller U3.

Microcontroller U3 is addressable by user interface 10 shown in FIG. 1 to received programming instructions, or to be queried for status information. PC interface 20 is connected between user interface 10 and microprocessor 22 to realize a hardware protocol for transmission of signals therebetween. PC interfaces U1 and U2 shown in FIG. 2 act as transceivers for communication between microprocessor 22 and user interface 10. Accordingly, interfaces U1 and U2 provide a high degree of electrical isolation between circuit 15 and user interface 10. A high degree of electrical isolation prevents damaging or dangerous conditions existing in circuit 15 from being transmitted to user interface 10 and causing further, potentially expensive, damage to user interface 10.

The input and output signals transmitted between user interface 10 and microprocessor 22 can carry information related to a protocol standard usable by user interface 10 and microprocessor 22. Accordingly, in FIG. 2, microcontroller U3 receives serial information on pin 7, and transmits serial information on pin 8. The content of the serial information transmitted and received corresponds to the selected protocol for communication. Microcontroller U3 can be loaded with an algorithm for interpreting the communication protocol in a simple manner. For example, both user interface 10 and microprocessor 22 can be programmed to communicate using the DALI standard for international addressable lighting interfaces. According to the DALI standard, a forward message frame consists of 19 bits, and a backward message frame consists of 11 bits. The bits in the transmitted frames are arranged according to a CODEC that is bi-phase to permit high levels of error detection.

Figure 3:
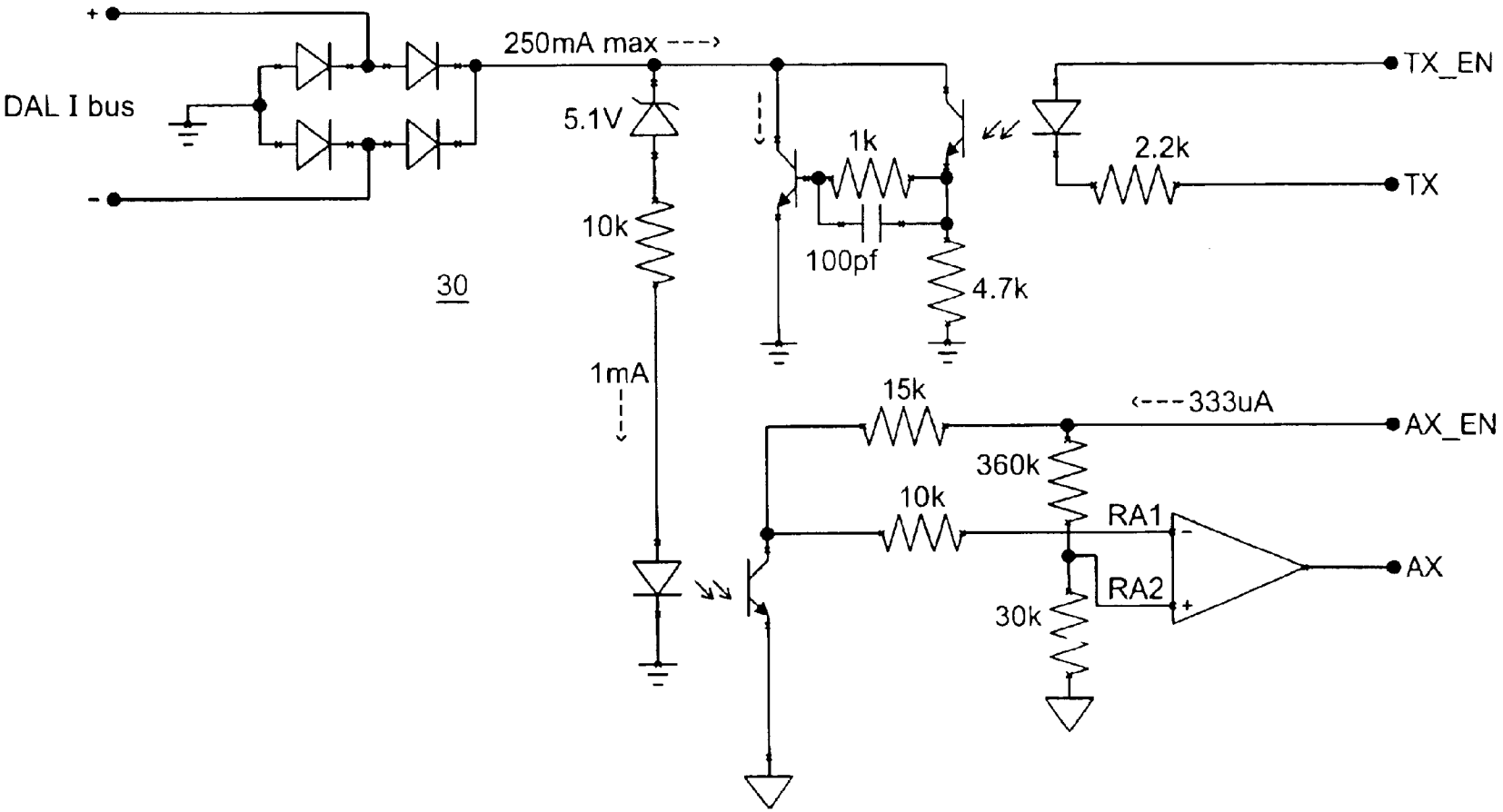
FIG. 3 shows a circuit diagram of the ballast PC interface.

Referring now to FIG. 3, a configuration for an optically isolated DALI bus is shown generally as circuit 30. According to this circuit diagram, a hardware platform for the DALI protocol is provided using transmit and receive enable signals, in addition to the transmit and receive signals.

Figure 4:
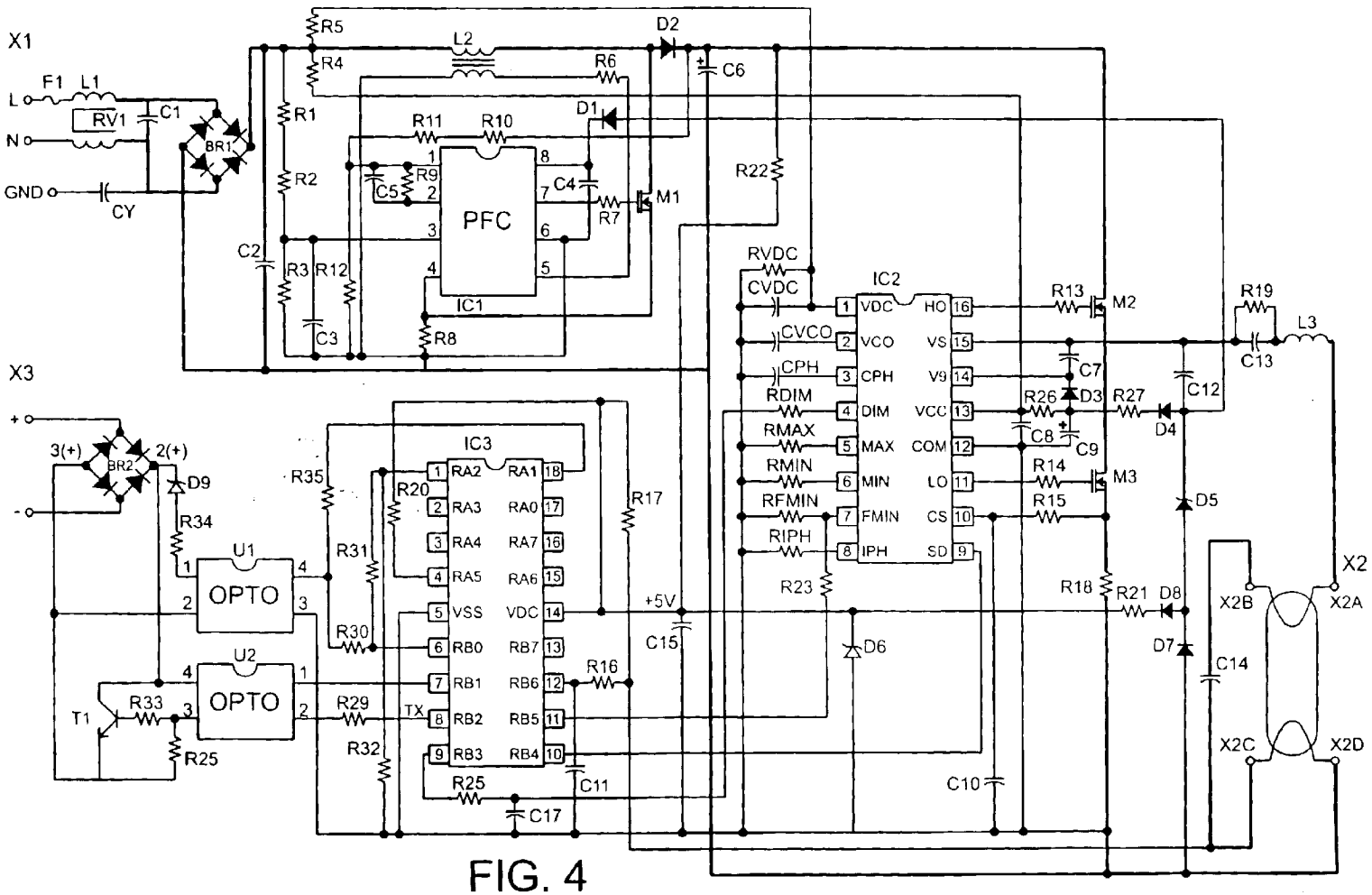
FIG. 4 shows a wiring diagram of another embodiment of the ballast interface.

Referring now to FIG. 4, the DALI bus of FIG. 3 is shown as PC interface 20 that includes a bridge rectifier and two optically isolated switch interfaces U1 and U2. In this configuration, interfaces U1 and U2 prevent electrical surges experienced in circuit 15 from being transmitted to user interface 10. Accordingly, interfaces U1 and U2 prevent potentially destructive signals from reaching user interface 10, while at the same time providing access to microcontroller IC3 for command and query transmission.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A digitally controlled fluorescent lamp ballast, comprising:

a power inverter output stage with an input connectable to a power line input and an output connectable to a fluorescent lamp for powering the fluorescent lamp;

a lighting controller coupled to the power inverter and operable to drive the power inverter to control power to the fluorescent lamp;

a digital microcontroller coupled to the lighting controller and operable to provide commands to the lighting controller for driving the power inverter; and a network communication interface coupled to the micro controller and operable to facilitate communication between the microcontroller and a network including a numerical computation machine, whereby the microcontroller and the numerical computation machine can exchange information.

2. A lamp ballast according to claim 1, further comprising:

a lighting control feed back between the power inverter and the lighting controller; and the lighting control feedback is operable to supply information to the lighting controller related to a condition of lamp operation.

3. A lamp ballast according to claim 1, further comprising:

a fault detection feedback between the power inverter and the microcontroller; and the fault detection feedback is operable to supply indicia related to at least one of a lamp and a lamp ballast fault.

4. A lamp ballast according to claim 1, further comprising:

a status query feedback between the lighting controller and the microcontroller; and the status query feedback is operable to supply information to the microcontroller related to a condition of lamp operation.

5. A lamp ballast according to claim 1, further comprising a storage memory coupled to the microcontroller, and the memory being operable to store a program executable by the microcontroller to provide the commands to the lighting controller.

6. A lamp ballast according to claim 5, wherein the program is transferred to the memory from the numerical computation machine.

7. A lamp ballast according to claim 1, wherein the communication interface is operable to be used with a network of lamp ballasts.

8. A lamp ballast according to claim 7, wherein the microcontroller has an address unique to the network.

9. A lamp ballast according to claim 8, wherein the microcontroller is operable with the communication interface to realize a communication protocol between the numerical computation machine and the microcontroller.

10. A digitally controlled lamp ballast, comprising:

a power inverter output stage with an input connectable to a power line input and an output connectable to a lamp for powering the lamp;

a lighting controller coupled to the power inverter and operable to drive the power inverter;

a digital microcontroller coupled to the lighting controller and operable to provide commands to the lighting controller for driving the power inverter;

a status feedback between the lighting controller and the microcontroller; and the microcontroller being operable to provide a standby command to the lighting controller based on a value of the status feedback, whereby the lighting controller is placed in a power standby condition.

11. A digitally controlled lighting ballast for a fluorescent lamp, comprising:

a combination lighting control and power converter for controlling and powering the lamp;

a microprocessor coupled to the combination for providing lighting operation commands;

a networkable computer inter face coupled to the microprocessor for interfacing with a network including at least on of a computer and another lighting ballast; and the interface has a high voltage electrical isolation between the lighting ballast and the network.

12. A lighting ballast according to claim 11, wherein the electrical isolation is achieved with an optical switch interface.

13. A control system for controlling a digital lighting ballast, comprising:

a user interface for receiving user commands and presenting ballast information;

an addressable network of lighting ballasts coupled to the user interface for exchanging information between the lighting ballasts and the user interface;

the user interface being responsive to user commands to provide operational commands to selected lighting ballasts and receive status information from the selected lighting ballasts;

the user interface and the lighting ballasts have a high voltage electrical isolation therebetween; and the lighting ballasts and the user interface exchange information according to a established communication protocol.

14. A method of controlling a lamp ballast, comprising:

receiving from a lighting controller a status signal at a microprocessor for determining a lamp status;

providing a command signal from the microprocessor to the lighting controller to place the lighting controller in a power standby mode according to a value of the status signal; and providing another command signal from the microprocessor to the lighting controller to remove the lighting controller from the power standby mode according to another value of the status signal.

15. A method of operating a lamp ballast, comprising:

exchanging information between a computer and a microprocessor in the lamp ballast through a high voltage eclectically isolated interface;

using information received by the microprocessor to control the lamp ballast;

receiving at the microprocessor feedback status information related to an operating condition of the lamp ballast; and transferring the feedback status information to the computer for at least one of storage and display.

16. A method according to claim 15, further comprising:

storing in the microprocessor a command profile received from the computer; and using the command profile to control the lamp ballast.

* * * * *